US007241727B2

(12) United States Patent
Hart et al.

(10) Patent No.: US 7,241,727 B2
(45) Date of Patent: Jul. 10, 2007

(54) FABRIC-CLEANING COMPOSITIONS

(76) Inventors: Gerald Leslie Hart, deceased, late of Surbiton (GB); by Susan Hart, legal representative, 38 Villers Avenue, Subriton, Surrey KT5 8BD (GB); Colin William Brown, 5 Clandon Avenue, Egham, Surrey TW20 8LP (GB); Anjum Fatima Shaukat, 7 Crane Road, Twickenham, Middlesex TW2 (GB)

( * ) Notice: Subject to any disclaimer, the term of this patent is extended or adjusted under 35 U.S.C. 154(b) by 362 days.

(21) Appl. No.: 10/481,734

(22) PCT Filed: Jun. 27, 2002

(86) PCT No.: PCT/CH02/00351

§ 371 (c)(1),
(2), (4) Date: Jun. 3, 2004

(87) PCT Pub. No.: WO03/002701

PCT Pub. Date: Jan. 9, 2003

(65) Prior Publication Data

US 2005/0032666 A1 Feb. 10, 2005

(30) Foreign Application Priority Data

Jun. 28, 2001 (EP) ..... 01115595

(51) Int. Cl.

| | |
|---|---|
| ***C11D 1/12*** | (2006.01) |
| ***C11D 1/72*** | (2006.01) |
| ***C11D 3/18*** | (2006.01) |
| ***C11D 3/43*** | (2006.01) |
| ***C11D 17/00*** | (2006.01) |

(52) U.S. Cl. ..... 510/279; 510/280; 510/283; 510/289; 510/291; 510/342; 510/360; 510/406; 510/413; 510/432; 8/137

(58) Field of Classification Search ..... 510/279, 510/280, 283, 289, 291, 342, 360, 406, 413, 510/432; 8/137
See application file for complete search history.

(56) References Cited

U.S. PATENT DOCUMENTS

| | | | | |
|---|---|---|---|---|
| 4,362,638 A | | 12/1982 | Caskey et al. | 252/90 |
| 4,954,286 A | * | 9/1990 | Sepulveda et al. | 510/284 |
| 5,902,225 A | | 5/1999 | Monson | 516/10 |
| 5,962,396 A | | 10/1999 | Pollack et al. | 510/433 |

FOREIGN PATENT DOCUMENTS

| | | | |
|---|---|---|---|
| EP | 0 586 295 A1 | | 3/1994 |
| EP | 0 890 670 A2 | | 1/1999 |
| EP | 890670 | * | 1/1999 |
| GB | 1040009 | | 8/1966 |
| WO | WO 00/39273 | | 7/2000 |

OTHER PUBLICATIONS

PCT International Search Report for PCT/CH02/00351 dated Oct. 15, 2002.

* cited by examiner

*Primary Examiner*—Brian Mruk
(74) *Attorney, Agent, or Firm*—Norris McLaughlin & Marcus, PA

(57) ABSTRACT

The invention is concerned with post-foaming cleaning compositions which may be dispensed from a pressurised container. The compositions contain a post-foaming agent, for example a volatile hydrocarbon which boils and causes the composition to fizz on the surface of a fabric to be cleaned thereby enhancing the cleaning effect. The compositions contain high amount of volatile hydrocarbon, i.e. about 20 to 40% by weight, and a surfactant component consisting of or comprising a fatty alcohol ethoxylate.

7 Claims, No Drawings

FABRIC-CLEANING COMPOSITIONS

This invention relates to a post-foaming cleaning composition which may be applied to a surface to be cleaned and which foams at that surface to provide a cleaning effect.

Post-foaming cleaning compositions are known in the art. Such compositions contain a post-foaming agent, typically a hydrocarbon that is volatile at room temperature and pressure, that boils when discharged from a container causing the composition to foam. Typical post-foaming cleaning compositions are disclosed in U.S. Pat. Nos. 6,004,920, 5,962,396 and 6,051,542.

The post-foaming compositions described in the aforementioned patents contain relatively low amounts of volatile hydrocarbon, i.e. about 7 to 14% by weight of iso-pentane. This relatively low amount of post-foaming agent limits the cleaning effect of such compositions. In addition, the low quantities of volatile hydrocarbon are insufficient to provide the composition with satisfactory propellant effect in order to discharge itself effectively from its container upon actuation of the container. Accordingly, not only do such compositions have limited cleaning effect, they must be packaged in containers which provide propellant means external of the composition. Such containers, e.g. the so-called bag-in-can containers are relatively expensive compared with standard aerosol canisters.

However, as one attempts to incorporate higher amounts of volatile hydrocarbon into post-foaming cleaning compositions, so the volatile hydrocarbon displays an increased tendency to form a separate phase from the remaining components of the composition. This is undesirable because phase-separated hydrocarbon does not have as effective a cleaning or foaming effect as hydrocarbon mixed or dissolved in the composition. Accordingly, whereas phase-separated hydrocarbon could act as a propellant, its cleaning or foaming effect would not be in proportion to the increase in the amounts of hydrocarbon employed.

Accordingly, there remains a need to provide cleaning compositions with efficient cleaning power that may be dispensed from relatively cheap pressurised containers.

It has now been found that it is possible to produce a composition containing post-foaming and propellant quantities of liquid hydrocarbon that is stable to phase separation.

The invention therefore provides in a first aspect a post-foaming cleaning composition comprising a post-foaming agent in an amount of at least 20% and more preferably from 20 to 40% by weight based on the total weight of the composition.

The post-foaming agent may be dissolved or mixed in the composition in higher amounts than have heretofore been possible. When discharged onto a surface to be cleaned the composition penetrates the surface whereupon the post-foaming agent boils causing the composition to foam vigorously and for extended periods of time, e.g. for up to 15 minutes. Vigorous foaming not only provides a visible and audible key which suggests to the user that the composition is working effectively, it also, by virtue of the mechanical action of the foam on the surface to be cleaned, facilitates and enhances the cleaning action. In contrast, if the post-foaming agent is substantially phase-separated in the dispensing device, it will be dispensed separately from the remainder of the composition. In addition to the reduced cleaning or foaming effect aforementioned, the dispensed free post-foaming agent is unsightly for the user and suggests that the composition has malfunctioned.

In a preferred embodiment of the invention the post-foaming agent is a hydrocarbon, and may be any of those hydrocarbons that are volatile at room temperature and pressure and which are useful as post-foaming agents and propellants, for example a saturated aliphatic hydrocarbon having from 4 to 5 carbon atoms, more particularly n-butane, iso-butane, n-pentane or iso-pentane, or mixtures thereof. Most preferred is n-pentane.

A composition according to the invention may have the form a low viscosity free-flowing liquid. The viscosity should be such that when dispensed, the composition is mobile, in order that it may wet and penetrate readily into the surface to be cleaned, e.g. the surface of a fabric, such that the foaming occurs substantially within the weave of the fabric thereby to mechanically agitate the fabric for better stain removal. The foam produced by the composition should be rather mobile and unstable. Rigid, stable foams, typical of the gel-like foamable compositions in the prior art, would have the disadvantage of holding or lifting large amounts of the cleaning actives away from the surface to be cleaned. Stable foams would also contribute to undesirable foaming in a washing machine used to clean a fabric subsequent to its treatment with a post-foaming composition.

Preferred compositions according to the invention have a viscosity at 25° C. of up to about 400 centipoise, more particularly 250 to 350 centipoise.

Compositions according to the invention may contain any of those components employed in post-foaming cleaning compositions known in the art. Typically a composition may comprise a hydrophobic component, a hydrophilic component, a surfactant component, and other adjuvants or additives commonly employed in the art.

The hydrophilic component is water, e.g. de-ionised water, preferably present in amounts of about 20 to 40% by weight of the total composition.

As hydrophobic component there may be mentioned those water insoluble saturated or unsaturated organic compounds having from 4 to 30 carbon atoms commonly used in the formation of an oil-phase. Preferred as the hydrophobic component are isoparaffinic hydrocarbons, in particular those having a boiling point in the range of about 113 to 143° C. A typical example of a suitable hydrophobic component is ISOPAR E® from Exxon Chemicals Europe Inc. The hydrophobic component is preferably used in an amount of about 15 to 20% by weight, more preferably 15.75 to 19.25% by weight.

The surfactant component consists of or comprises a fatty alcohol alkoxylate, more particularly a fatty alcohol ethoxylate, e.g. a C13 to C15 fatty alcohol ethoxylate. The ethylene oxide (EO) content of the fatty alcohol ethoxylate may vary between 1 to 5 EO units per fatty alcohol unit, more particularly, 3 EO units per fatty alcohol unit. The fatty alcohol ethoxylate preferably has an Hydrophilic Lipophilic Balance (HLB) of about 4 to 10. A suitable example is Lutensol AO3®, BASF AG, Ludwigshafen, Germany.

The presence of the fatty alcohol alkoxylate is believed to play an important role in stain removal and stabilising the composition, that is, it offers classical detergency properties and also assists in the formation of a composition comprising high amounts of post-foaming agent, and reduces the tendency for the post-foaming agent to form a separate phase. The precise amounts of fatty alcohol alkoxylate needed to provide a stain-removing and stabilising effect may vary within wide limits depending on the nature and amount of other components present in the composition. However, having been apprised of the significance this component, the skilled person would be able to experiment without undue burden to determine an appropriate quantity of this component for a given composition.

Preferred compositions according to the invention contain fatty alcohol alkoxylate, e.g. fatty alcohol ethoxylate in an amount of greater than about 7% by weight, more particularly about 7 to 13% by weight of the total composition. Within this preferred range, higher amounts of surfactant promote stability of the composition. However, if the amount of surfactant exceeds the upper limit the stain-removing effect when a treated fabric is washed diminishes.

The surfactant component may comprise a mixture of surfactants, thus in a preferred embodiment the composition comprises a first and second surfactant component.

The first surfactant component is a fatty alcohol ethoxylate as herein above described.

The second surfactant component is a fatty alcohol alkoxylate that is different from said first surfactant component and is preferably not a fatty alcohol ethoxylate. Aside from these conditions, it may be any of those fatty alcohol alkoxylates known for use in stain removing compositions in the art. Preferably the second surfactant component is a C12–C18 fatty alcohol ethoxylate alkoxylate, e.g. a C12–C18 fatty alcohol ethoxylate butoxylate, which preferably has a cloud point in water of between 28 and 42° C. A particularly preferred second surfactant component is Plurafac LF221 from BASF AG.

The second surfactant component may be employed in amounts of about 1.5 to 2.5% by weight, more particularly about 1.9 to 2.3% by weight based on the total weight of the composition.

The composition may comprise other adjuvants that serve to stabilize the interfacial tension between the hydrophilic and hydrophobic components. These components are often referred to as co-surfactants and co-solvents. The composition may comprise one or more of these co-surfactants in appropriate quantities to achieve a stabilized composition. The nature and precise quantities of co-surfactants used in a composition may be determined by the skilled person without undue burden and using only routine experimentation, having regard to the nature and relative proportions of the hydrophilic and hydrophobic components.

The compositions preferably employ first and second co-surfactants. Said first co-surfactant may be selected from any of those di-alkylsulphosuccinates known in the art. More particularly, the first co-surfactant is a sodium di-alkyl sulphosuccinate, e.g. sodium dioctylsulphosuccinate. The first co-surfactant may be employed in amounts of about 1.9 to 2.4% by active weight based on the total weight of the composition. Preferably the first co-surfactant is Rewopol SBDO 75, Goldschmidt AG, Germany.

A second co-surfactant may be selected from any of the long chain unsaturated fatty acids useful as co-surfactants, in particular $C_{16}$ to $C_{18}$ unsaturated fatty acids, more particularly oleic acid. Said second co-surfactant may be employed in amounts of about 2.5 to 3.1% by active weight based on the total weight of the composition. Preferably said second co-surfactant is Priolene 6992, Uniqema, England.

A co-solvent may be selected from short-chained linear or branched aliphatic alcohols, e.g. iso-propanol. Said co-solvent may be present in amounts of about 7.5 to about 9.3% by weight of the total weight of the composition.

The pH of the composition is preferably in the range of about 8 to 9, more preferably 8.2 to 8.7. To maintain the composition at slightly alkaline pH it is preferred to employ an alkaline substance such as an alkali metal hydroxide, e.g. sodium hydroxide.

Additionally, compositions may comprise other additives or adjuvants commonly used in post-foaming cleaning compositions, for example preservatives or fragrances, provided that such agents do not adversely affect the properties of the composition. These additives may be employed in conventional amounts and preferably do not constitute more than about 1% by weight of the total composition, for example fragrances or preservatives may be added in small amounts, e.g. about 0.1 to 1.0% by weight and about 0.005 to about 0.1% by weight respectively.

In a preferred embodiment of the present invention there is provided a post-foaming cleaning composition comprising about 20 to 40 weight percent (wt %) of deionised water; 20 to 40 wt % n-butane; 15.75% to 19.25 wt % isoparaffinic hydrocarbon with a boiling point of 113 to 143° C.; 7.5 to 9.3 wt % isopropanol; 7.1 to 13.0 wt % fatty alcohol ethoxylate (HLB 4 to 10); 2.5 to 3.1 wt % sodium di-alkyl sulphosuccinate (75%); 1.9 to 2.3 wt % of a fatty alcohol ethoxylate butoxylate having a cloud point in water of between 28 and 42° C.; 2.5 to 3.1% oleic acid; 0.32 to 0.38 wt % sodium hydroxide (47%); optionally 0.1 to 1.0 wt % of a fragrance material; and optionally 0.005 to 0.1 wt % of a preservative, e.g. 2-bromo-2-nitropropane-1,3-diol.

The hydrophilic component and the post-foaming agent are the components present in the greatest quantity in a composition of the present invention, and together they may consist of up to about 80% by weight of the composition. The ratio of these combined components (hereinafter A) to the remaining components with the exception of any fragrance and preservatives (hereinafter B) may vary within a wide range without affecting the stability or effectiveness of the composition. Preferably the weight ratio A:B may be from about 1.4:1 to about 1.1:1. Particularly preferred compositions comprise components A in an amount of about 58 weight percent and components B in an amount of about 42 weight percent; or, components A in an amount of about 55. weight percent and components B in an amount of about 45 weight percent; or components A in an amount of about 52 weight percent and components B in an amount of about 48 weight percent. Any remaining mass is made up by fragrances and preservatives.

Compositions according to the invention are preferably microemulsions. Microemulsion compositions are preferably employed because of their ability to wet both hydrophobic and hydrophilic surfaces. This may be particularly beneficial when a fatty stain is to be cleaned from a hydrophilic surface presented by certain fabrics, e.g. cotton fabrics.

A composition according to the invention may be made by any procedure commonly known in the art for the preparation of post-foaming cleaning compositions. A particular method comprises admixing all of the components with the exception of the post-foaming agent until a homogeneous mixture is formed. Thereafter, the mixture may be poured into a conventional aerosol can, a valve assembly fitted to the filled aerosol can and the post-foaming agent added in gaseous form using conventional high-pressure filling equipment. The packaged composition is thereby pressurised at a pressure such that the post-foaming agent is substantially all in the liquid phase and substantially all is dispersed or dissolved in the composition. In the case of n-butane, the post-foaming agent is added under a pressure of about 48 psi ($3.3\times10^5$ N/m$^2$).

The invention provides in another of its aspects a packaged composition as herein above described. By <<packaged>> is meant that the composition is provided in containers that are suitable for dispensing such cleaning compositions. Appropriate containers include those containers known in the art that are capable of withstanding cleaning compositions under pressure and include standard tin-plate aerosol cans that may or may not need to be internally lacquered or to be protected from corrosion by the inclusion of inhibitors in the composition.

Whereas the invention is primarily concerned with packaged compositions employing the relatively inexpensive standard aerosol containers, the compositions may also be packaged in the variety of containers known as bag-in-can containers more fully described in U.S. Pat. No. 4,964,540. The latter packaged compositions may not be as cost-effective as those employing aerosol canisters, but the dispensed compositions nevertheless realise substantially the same cleaning effect.

Packaged compositions according to the invention are monophasic, that is substantially all of the post-foaming agent is dissolved in, or mixed with, the compositions' other ingredients. A monophasic composition has the advantage that substantially all of the post-foaming agent will be discharged in admixture with the remainder of the composition. Accordingly, as the post-foaming agent boils it causes the composition to fizz and bubble more vigorously and for a longer period of time than would occur if significant amounts of the post-foaming agent were discharged separately.

Due to the relatively high amounts of hydrocarbon post-foaming agent dissolved in compositions according to the invention, the hydrocarbon may act as both post-foaming agent and propellant. This enables compositions according to the invention to be packaged in the relatively inexpensive standard aerosol containers as aforementioned. In such an embodiment, the hydrocarbon may be used as the sole propellant. Alternatively, additional propellants may be used, for example a container may be pressurised with propellant gases such as nitrogen, carbon dioxide, compressed air, halogenated compounds or nitrous oxide. Preferably any additional propellant would not be a volatile organic compound for environmental reasons.

Compositions according to the invention may be applied to surfaces that need to be cleaned to provide efficient pre-spotting, that is, the composition acts on a stain to start the cleaning process and to enable enhanced stain removal during a subsequent wash cycle. Compositions are particularly effective pre-spotters for oily stains, such as vegetable and motor oils, shoe polish and lipstick. The compositions may be used on a variety of fabrics such as cotton, polyester, wool, polyester/cotton, and polyester/wool. Microemulsion compositions are particularly useful as pre-spotters for oily stains on hydrophilic fabrics such as cotton due to the ability of microemulsions to wet both hydrophobic and hydrophilic surfaces.

There now follows a series of examples that serve to illustrate the invention.

EXAMPLE 1

Formation of a Post-foaming Microemulsion Composition

The composition set forth herein below was made according to the following procedure:

1. Add deionised water into a main mixing vessel
2. Add Bronopol with stirring
3. Add the following materials in the order listed and ensure good agitation at 25° C. until a homogenous solution is formed: NaOH; Isopropanol; Oleic Acid; $C_{13}$–$C_{15}$ fatty alcohol ethoxylate 3 EO (warm to 25° C. before addition); $C_{13}$–$C_{15}$ fatty alcohol ethoxylate butoxylate; Sodium di-octyl sulphosuccinate 75%; Fragrance.
4. Finally add Isopar E with continuous stirring until the mixture is homogenous and clear at 22° C. Continue stirring for at least 15 minutes.
5. Check pH of the mixture. Adjust to approx. 8.5 if necessary using 30% sodium hydroxide solution or oleic acid. Continue stirring for 20–30 minutes.

The mixture was poured into a glass aerosol bottle. A valve assembly was fitted over the aerosol bottle prior to introducing the n-butane under a pressure of 48 psi. The n-butane dissolved fully in the composition and the final composition had the appearance of a monophasic solution.

| | wt % |
|---|---|
| Deionised water | 28.126 |
| n-Butane | 30.000 |
| Isoparaffinic hydrocarbon Bpt. 113–143 (ISOPAR E - Exxon Chemicals | 17.500 |
| Isopropanol | 8.400 |
| C13–C15 fatty alcohol ethoxylate 3EO (Lutensol AO3. BASF) | 7.700 |
| Sodium di-alkyl sulphosuccinate 75% (Rewopol SBDO 75 Goldschmidt) | 2.800 |
| Oleic acid (Priolene 6992 - Uniqema) | 2.800 |
| C13–C15 linear alcohol ethoxylate butoxylate (Plurafac LF221, BASF) | 2.100 |
| Sodium hydroxide 47% | 0.350 |
| Fragrance | 0.210 |
| Preservative (Bronopol, BASF) | 0.014 |
| pH of formula | 8.2–8.7 |

EXAMPLE 2

The Effect of Fatty Acid Ethoxylate Concentration on Appearance of Compositions

The following compositions were formed according to the methodology of Example 1. The composition <<D>> corresponds to the composition of Example 1. All quantities are expressed in weight percent. The fatty alcohol ethoxylate was Lutensol AO3 from BASF.

| | A | B | C | D | E |
|---|---|---|---|---|---|
| Deionised water | 24.626 | 26.726 | 27.426 | 28.126 | 28.826 |
| Butane 48 psig | 30.000 | 30.000 | 30.000 | 30.000 | 30.000 |
| Isoparaffinic hydrocarbon Bpt. 113–143 | 17.500 | 17.500 | 17.500 | 17.500 | 17.500 |
| Isopropanol | 8.400 | 8.400 | 8.400 | 8.400 | 8.400 |
| C13–C15 fatty alcohol ethoxylate 3EO | 11.200 | 9.100 | 8.400 | 7.700 | 7.000 |
| Sodium di-alkyl sulphosuccinate 75% | 2.800 | 2.800 | 2.800 | 2.800 | 2.800 |
| Oleic acid | 2.800 | 2.800 | 2.800 | 2.800 | 2.800 |
| Fatty alcohol alkoxylate | 2.100 | 2.100 | 2.100 | 2.100 | 2.100 |
| Sodium hydroxide 47% | 0.350 | 0.350 | 0.350 | 0.350 | 0.350 |
| Fragrance | 0.210 | 0.210 | 0.210 | 0.210 | 0.210 |
| Preservative | 0.014 | 0.014 | 0.014 | 0.014 | 0.014 |

Compositions A, B, C and D when filled in glass aerosol bottles all gave single-phase systems. Formulation E demonstrated a significant layer of free hydrocarbon above the composition. This suggests that the linear alcohol ethoxylate should be present in an amount of greater than 7% by weight to obtain a monophasic composition.

Upon discharge from the aerosol container, compositions A, B, C and D all presented as a creamy liquid that bubbled for several seconds on contact with the fabric thus providing a good visible cue as to the cleaning effect. Composition E, however, lacked uniformity, presenting a clear liquid that was essentially pure hydrocarbon.

EXAMPLE 3

Stain Pre-spotting Performance

All fabric used for this test (100% white cotton) was washed to remove any 'finishing' treatment on the new material. This was done by washing 3–4 m of fabric at 40° C. (European washing machine) using 50 g of non-biological washing powder (Persil automatic). The fabric was partially dried and then ironed to remove creasing. The fabric was then cut into swatches of 14.5 cm by 22 cm using a zig-zag scissors to prevent fraying. All swatches were ironed again and laid on a worktop ready for staining (matt side up to prevent excess 'wicking').

Since the compositions would be specifically targeted for removal of stubborn oily stains, the test focused on the four key oily stains which are difficult to remove in a standard wash, viz.

Vegetable oil—dyed using oil soluble brown dye—1 drop 0.5% w/w

Motor oil—used engine oil—1 drop

Shoe polish—black Kiwi® brand—1 stroke

Lipstick—red or bright pink—1 stroke

Drops were applied using pipettes and strokes were applied using a 10 mm spatula. All prepared swatches were left to set overnight prior to being tested.

Washing was conducted under European conditions using European washing machines at 40° C . A 'dummy' load was used, which consisted of 6 cotton terry nappies. 50 g of non-biological Persil automatic washing powder was used. 9.5 g of pre-spotter was applied to the stained swatch and left for one minute. This was then washed as normal in the washing machine together with the 'dummy' load. The washed swatches were then removed and ironed on the side opposing the stained surface. All testing was conducted in duplicate using non-biological washing powder, either with or without pre-spotter. An untreated swatch was also used to compare the 'before' and 'after' results.

The stain-removal performance was rated visually by a trained panel using a scale of 1 to 5, Where, 1=little or no stain removal 5=complete stain removal The results were tabulated and converted into percentage stain removal in order to compare the overall performance.

| | Stains tested | | | | | | |
|---|---|---|---|---|---|---|---|
| | Untreated | A | B | C | D | E | Shout ® |
| Vegetable oil | 1.0 | 4.0 | 4.5 | 4.5 | 4.5 | 4.5 | 3.5 |
| Motor oil | 1.0 | 2.0 | 3.0 | 3.0 | 4.5 | 4.5 | 3.0 |
| Lipstick | 1.0 | 1.5 | 3.0 | 3.0 | 3.0 | 2.5 | 1.5 |
| Shoe polish | 1.0 | 1.5 | 1.5 | 1.5 | 1.5 | 1.5 | 1.5 |
| TOTAL | 4.0 | 9.0 | 12.0 | 12.0 | 13.5 | 13.0 | 9.5 |
| % Stain Removal | 20 | 45 | 60 | 60 | 68 | 65 | 48 |

The invention claimed is:

1. A post-foaming cleaning composition comprising 20 to 40 weight percent (wt %) deionised water; 20 to 40 wt % n-butane; 15.75% to 19.25 wt % isoparaffinic hydrocarbon with a boiling point of 113 to 143° C.; 7.5 to 9.3 wt % isopropanol; 6.0 to 13.0 wt % fatty alcohol ethoxylate (HLB 4 to 10); 2.5 to 3.1 wt % sodium di-alkyl sulphosuccinate (75%); 1.9 to 2.3 wt % of a fatty alcohol alkoxylate having a cloud point in water of between 28 and 42 DEG C.; 2.5 to 3.1% oleic acid; 0.32 to 0.38 wt % sodium hydroxide (47%); optionally 0.1 to 1.0 wt % of a fragrance material; and optionally 0.005 to 0.1 wt % of a preservative.

2. A composition according to claim 1 wherein the composition is a microemulsion.

3. A packaged monophasic post-foaming cleaning composition comprising the cleaning composition of claim 1.

4. A packaged composition according to claim 3 wherein the packaging is provided by an aerosol canister.

5. A composition according to claim 1 comprising 28.126 wt % deionised water; 30 wt % n-butane; 17.5 wt % isoparaffinic hydrocarbon with a boiling point of 113–143; 8.4 wt % isopropanol; 7.7 wt % C13–C15 linear alcohol ethoxylate 3EO; 2.8 wt % sodium di-alkyl sulphosuccinate 75%; 2.8 wt % oleic acid; 2.1 wt % fatty alcohol alkoxylate having a cloud point in water of between 28 and 42° C.; 0.35 wt % sodium hydroxide 47%; 0.210 wt % fragrance; and 0.014 wt % preservative.

6. A method of pre-spotting a stained fabric comprising the step of applying thereto a post-foaming cleaning composition which comprises 20 to 40 weight percent (wt %) deionised water; 20 to 40 wt % n-butane; 15.75% to 19.25 wt % isoparaffinic hydrocarbon with a boiling point of 113 to 143° C.; 7.5 to 9.3 wt % isopropanol; 6.0 to 13.0 wt % fatty alcohol ethoxylate (HLB 4 to 10); 2.5 to 3.1 wt % sodium di-alkyl suiphosuccinate (75%); 1.9 to 2.3 wt % of a fatty alcohol alkoxylate having a cloud point in water of between 28 and 42 DEG C.; 2.5 to 3.1% oleic acid; 0.32 to 0.38 wt % sodium hydroxide (47%); optionally 0.1 to 1.0 wt % of a fragrance material; and optionally 0.005 to 0.1 wt % of a preservative.

7. A method of pre-spotting a stained fabric according to claim 6 comprising the step of applying thereto a composition wherein the composition comprises 28.126 wt % deionised water; 30 wt % n-butane; 17.5 wt % isoparaffinic hydrocarbon with a boiling point of 113–143; 8.4 wt % isooropanol; 7.7 wt % C13–C15 linear alcohol ethoxylate 3EO; 2.8 wt % sodium di-alkyl sulphosuccinate 75%; 2.8 wt % oleic acid; 2.1 wt % fatty alcohol alkoxylate having a cloud point in water of between 28 and 42° C.; 0.35 wt % sodium hydroxide 47%; 0.210 wt % fragrance; arid 0.014 wt % preservative.

* * * * *